US009435585B2

(12) United States Patent
Lam

(10) Patent No.: US 9,435,585 B2
(45) Date of Patent: Sep. 6, 2016

(54) MICROWAVE DRYER AND MICROWAVE DRYING METHOD

(76) Inventor: Kwok Fai Lam, Kowloon (HK)

( * ) Notice: Subject to any disclaimer, the term of this patent is extended or adjusted under 35 U.S.C. 154(b) by 749 days.

(21) Appl. No.: 13/806,077

(22) PCT Filed: Jul. 23, 2010

(86) PCT No.: PCT/CN2010/075418

§ 371 (c)(1),
(2), (4) Date: Dec. 20, 2012

(87) PCT Pub. No.: WO2012/009859

PCT Pub. Date: Jan. 26, 2012

(65) Prior Publication Data

US 2013/0091722 A1 Apr. 18, 2013

(51) Int. Cl.
*F26B 3/347* (2006.01)

(52) U.S. Cl.
CPC ..... *F26B 3/347* (2013.01); *F26B 2200/04* (2013.01)

(58) Field of Classification Search
CPC ..... F26B 2200/04; F26B 3/347; B30B 9/18
USPC ..... 34/265
See application file for complete search history.

(56) References Cited

U.S. PATENT DOCUMENTS 2,373,374 A * 4/1945 Bierwirth ..... 536/56
2,714,453 A * 8/1955 Miller ..... 209/142
3,285,157 A * 11/1966 Smith, Jr. ..... 99/476
3,312,342 A * 4/1967 Brown ..... 209/3
3,545,093 A * 12/1970 Forster ..... 34/262
3,620,459 A * 11/1971 Van Der Lely ..... 239/670
3,843,457 A * 10/1974 Grannen et al. ..... 201/2.5
3,849,900 A * 11/1974 Dale et al. ..... 34/368
3,877,365 A * 4/1975 Berggren ..... B30B 9/124 100/117
3,921,512 A * 11/1975 Burns ..... B30B 9/18 100/117
3,947,659 A * 3/1976 Ono ..... A45D 20/00 34/91
4,229,886 A * 10/1980 Durant ..... 34/92
4,330,946 A * 5/1982 Courneya ..... 34/263
RE32,307 E * 12/1986 Glatt et al. ..... 366/102
4,640,020 A * 2/1987 Wear et al. ..... 34/263
4,759,300 A * 7/1988 Hansen et al. ..... 110/229
4,771,156 A * 9/1988 Strattan et al. ..... 219/757
4,795,871 A * 1/1989 Strattan et al. ..... 219/707
4,905,918 A * 3/1990 Selles et al. ..... 241/39
4,915,506 A * 4/1990 Sato et al. ..... 366/146
5,052,313 A * 10/1991 Walker ..... 110/346
5,145,576 A * 9/1992 Lataillade ..... 210/180

(Continued)

FOREIGN PATENT DOCUMENTS

CN 1436996 A 8/2003
CN 1172151 C 10/2004

(Continued)

*Primary Examiner* — Kenneth Rinehart
*Assistant Examiner* — Logan Jones
(74) *Attorney, Agent, or Firm* — Rabin & Berdo, P.C.

(57) ABSTRACT

A microwave dryer and a microwave drying method are provided to evaporate water by using the penetrability of microwave. A wind screen (14) arranged in a dryer body (6) is used as a heat storage body to store heat temporarily when the material in the dryer body (6) is heated. Hot air in the dryer body (6) is extracted by an air discharging system and redelivered to the dryer body (6) from the bottom of the dryer. The specific weight of the material after water is evaporated is reduced, so the dried material can be carried out of the dryer body (6) if enough wind power is provided.

21 Claims, 3 Drawing Sheets

(56) References Cited

U.S. PATENT DOCUMENTS

| | | | | |
|---|---|---|---|---|
| 5,172,487 | A * | 12/1992 | Hansen et al. | 34/291 |
| 5,270,000 | A * | 12/1993 | Goldner et al. | 422/21 |
| 5,397,551 | A * | 3/1995 | Won Sam | 422/186 |
| 5,400,524 | A * | 3/1995 | Crosnier Leconte et al. | 34/259 |
| 5,467,694 | A | 11/1995 | Mochizuki et al. | |
| 5,516,049 | A * | 5/1996 | Zoncada | 241/34 |
| 5,589,140 | A * | 12/1996 | Takahashi | 422/159 |
| 5,611,268 | A * | 3/1997 | Hamilton | B30B 9/3089 100/50 |
| 5,904,885 | A * | 5/1999 | Arastoopour et al. | 264/115 |
| 5,977,528 | A * | 11/1999 | Petersen et al. | 219/690 |
| 6,337,302 | B1 * | 1/2002 | Teng et al. | 502/432 |
| 6,398,921 | B1 * | 6/2002 | Moraski | 204/157.43 |
| 6,524,539 | B1 | 2/2003 | Katschnig et al. | |
| 6,693,265 | B1 * | 2/2004 | Bell et al. | 219/686 |
| 7,908,765 | B2 * | 3/2011 | Waldron et al. | 34/138 |
| 7,938,271 | B2 * | 5/2011 | Irisarri Navalpotro | 209/11 |
| 8,354,005 | B2 * | 1/2013 | Kasin | 201/2.5 |
| 2002/0174562 | A1 * | 11/2002 | Pearcy et al. | 34/284 |
| 2002/0177745 | A1 * | 11/2002 | Bullock | 585/240 |
| 2005/0029174 | A1 * | 2/2005 | Collins | 210/143 |
| 2005/0120583 | A1 * | 6/2005 | Huttlin | 34/506 |
| 2005/0160667 | A1 * | 7/2005 | Weinberg et al. | 44/620 |
| 2005/0274035 | A1 * | 12/2005 | Beal et al. | 34/63 |
| 2006/0124040 | A1 * | 6/2006 | Walker | 110/234 |
| 2007/0131591 | A1 * | 6/2007 | Pringle | 208/402 |
| 2010/0115785 | A1 * | 5/2010 | Ben-Shmuel et al. | 34/260 |
| 2010/0132210 | A1 * | 6/2010 | Kruger | 34/259 |
| 2010/0154728 | A1 * | 6/2010 | Kemper et al. | 123/3 |
| 2010/0301147 | A1 * | 12/2010 | Harkess et al. | 241/23 |
| 2011/0219679 | A1 * | 9/2011 | Budarin et al. | 44/605 |
| 2011/0224474 | A1 * | 9/2011 | Denton | 588/20 |

FOREIGN PATENT DOCUMENTS

| | | | |
|---|---|---|---|
| CN | 101122440 | A | 2/2008 |
| CN | 101210771 | A | 7/2008 |
| EP | 0312741 | * | 4/1989 |
| EP | 0814311 | A1 | 12/1997 |
| JP | 61-200594 | U | 12/1986 |
| JP | 05-071871 | A | 3/1993 |
| JP | 2000-234857 | A | 8/2000 |
| JP | 2002-272445 | A | 9/2002 |

* cited by examiner

MICROWAVE DRYER AND MICROWAVE DRYING METHOD

TECHNICAL FIELD

The present invention relates to technical field of microwave drying, particularly, the present invention relates to a microwave dryer and a microwave drying method for drying material rapidly with energy saving.

BACKGROUND OF THE INVENTION

At present, processing organic waste with moisture content in a range of 75% to 85% is a serious problem. Although there are various heat treatment methods, these methods require preliminary drying of the waste which consumes quite large amount of energy. Energy saving and waste reduction can be achieved for satisfying environmental friendly conditions by processing the material mentioned above using heat radiation energy from the microwave dryer.

Said microwave is electromagnetic wave in frequency of 300 MHz to 300 GHz and having wavelength of 1 mm to 1 m. The principle of drying is that the microwave generator radiates microwave to a material to be dried, water molecules in the material would rotate and vibrate synchronously in accordance with frequency of the microwave when the microwave is injected to internal of the material, as the water molecules in the medium material being heated are polar molecules. Under rapid change of electromagnetic field operating in high frequency, orientation of the polar molecules would change according to the change of the external electromagnetic field, resulting in movement of the polar molecules and friction between the polar molecules. In this moment, microwave field energy can be converted into heat energy inside the polar molecules, such that temperature of the internal and surface of the material can be risen at the same time, with a result of a series of physiochemical processes (for example heating and expansion effects etc.), so that large amount of water molecules would be evaporated out from the material to achieve purpose of microwave heat drying.

Microwave heating facilitates an object being heated to be a heating element itself, which is called an overall heating. Therefore, uniform heating can be achieved within a short period of time, while heat conduction process is not required. As such, this characteristics can facilitate the material of poor heat conductivity being heated and dried within a short time, thus energy utilization rate is improved and the size of furnace can be smaller than a conventional furnace. At the same time, the overall temperature of the material is risen when the material is under the microwave electromagnetic field. In this moment, the temperature of the surface of the material would decrease as water on the surface is vaporized, which would result in a temperature gradient of higher temperature in internal of the material and lower temperature in external of the material. The direction of this gradient is the same as the water vaporization. Therefore, the efficiency of microwave heating is extremely high.

A Chinese patent application with application number 200610048560.X (Publication Number is CN101122440A) discloses self-flowing microwave heating dryer. The dryer does not have any leakage of microwave. A body of the dryer is a self-flowing pipe having an inlet at its top and an outlet at its bottom, a feeding funnel device is configured at the inlet of the pipe, a discharging device is configured at the outlet of the pipe, the discharging device is in a form of rotational impeller and prevents leakage of microwave, at least two sets of microwave drying devices for microwave radiation drying of the material passing through the pipe are further equipped in series on the pipe. It can be seen that the dryer of this invention can be used for drying (heating) material in particle or powder form. A vertical (tilt) configuration of the material pipe can arrive at automatic self-falling down of the material inside the device. Such configuration is characterized in simple structure, ease of control of flow rate of the material, higher uniformity of drying and better effect of energy saving.

A Chinese patent application with application number 02100566.4 (Publication Number CN1436996) discloses an air blowing microwave drying device comprising a microwave drying furnace, a layer of polytetrafluoroethylene (PTFE) is coated on four walls of cavity of the furnace, a bottle of drying container is placed on a rotational disc at the bottom wall of the microwave drying furnace, the top part of neck of the container is extended out of the microwave drying furnace through an aperture on the top wall of the microwave drying furnace. A microwave suppressor is arranged respectively on the contact point between the neck of the container and the top wall of the microwave drying furnace and a port at the upper end of the neck of the container. Micropores are arranged on the surface of the end of the microwave suppressor. A gas distribution panel is installed at the bottom of the bottle of the drying container, the panel is configured horizontally and has micropores. An inlet pipe passes through in an order of the microwave suppressor, the gas distribution panel and the bottom of the bottle of the drying container. The power of the microwave drying furnace is 200 to 700 watts (W). This invention can timely get rid of water vapor and heat energy generated during drying process to avoid overheating of the internal of the material due to accumulation of water vapor and heat, such that quality of the dried material can be guaranteed.

A Chinese patent application with application number 200610160006.0 (publication number CN101210771) discloses a microwave drying apparatus, wherein an annular box is configured on a rack, there is a fixed panel extending more half of an annular chamber in cross-section inside the box, at least 9 sets of microwave waveguide devices and microwave generators are configured on the fixed panel, the microwave waveguide devices are uniformly distributed with staggered arrangement on the fixed panel, under the fixed panel is a microwave drying chamber, a heating rotational device is configured beneath the microwave drying chamber, the heating rotational device consists of a variable motor and a heating rotational disc, a moisture discharge mechanism is arranged at the middle part of the annular box, and left and right suppressors and the material loading area are arranged along the less than half of the annular chamber in cross-section inside the annular box. The apparatus has provided uniform microwave radiation, effectively improved uniformity of heating and increased versatility. Furthermore, its structure is compact that occupies less space, and is convenient for material loading and thus facilitates a continuous production.

The above existing microwave drying devices have shortcomings that the material drying time is still very long, or the material is required to be injected into the drying devices in batches such that the material could not be fed continuously.

SUMMARY OF THE PRESENT INVENTION

Therefore, the purpose of the dryer and the drying method of the present invention is to fully dry a large amount of material within a short time with minimum consumption of energy, and provides efficient utilization of energy. A relatively short drying time can cause minimal damage to the material and achieve optimal drying result.

In order to achieve the above purposes, the present invention provides a microwave dryer, comprising: input port of a material collection compartment having an input port, through which the material to be dried is fed into said material collection compartment; a dryer body comprising at least one microwave vibration head configured on an inner wall of said body for generating microwaves to dry said material; a propeller connected to said material collection compartment and said dryer body for delivering said material to be dried from said material collection compartment to said dryer body; and an air blower for feeding air into said dryer body to disperse and suspend said material to be dried inside the dryer body.

Said dryer body further comprises a power adjustment switch for adjusting power of said microwave vibration head.

Said propeller is driven by a motor and a gearbox which uses a ratio of size of gears to change a rotational speed of said propeller.

Said propeller is configured obliquely upward and said material to be dried inside said material collection compartment is delivered upwardly from a bottom of said propeller to said dryer body, said material would be compressed by said propeller during the delivery, such that said material is under gravitational force and compression by the propeller at the same time, so as to squeeze out water from said material during said delivery, wherein said material is discharged in an elongated paste form from an output port of said propeller into the dryer body.

The output port of said propeller is adjustable in size to facilitate delivery of different sizes of material in the elongated paste to an input port of said dryer body.

The dryer body is of cylindrical, rectangular or cubical configuration.

Said dryer body comprises a plurality of microwave vibration heads which are uniformly distributed on said inner wall of said body when viewing from a top of said dryer body, and which are arranged at different heights of said inner wall of said dryer body when viewing from a side of said dryer body, such that uniform distribution of a microwave field is produced inside said dryer body. Preferably, said plurality of microwave vibration heads is three microwave vibration heads.

Said microwave vibration head has a power of 1800-2000 watts with a frequency of 915 MHz-2450 MHz.

Said inner or an outer wall of said dryer body is coated with one or more layers of coating selected from the group consisting of aluminum foil, crystalline polyethylene terephthalate (CPET) and polytetrafluoroethylene (PTFE) for shielding said microwaves such that said microwaves do not leak out of said body.

Said dryer body further comprises a switch and a charged power supply on an outer wall of said body.

Said dryer body further comprises at least one material discharge port arranged on a top of said body for outputting the dried material.

Said dryer body further comprises a hot air extraction port connected to said air blower through which port said air blower delivers the hot air extracted from said body back to said body.

Said body further comprises a vapor cell adjacent to said hot air extraction port for storing condensed water from said hot air.

Said dryer body further comprises a conical, oval conical or hood-shaped wind screen (14) with its conical top facing upward and a disc-shaped or oval-shaped base; the conical top of said tubular wind screen is facing upward but it is in hollow conical shape without bottom surface; there is a gap between an outermost edge of said wind screen and said base, such that said hot air or air is blown out.

Preferably, said dryer body comprises a plurality of microwave vibration heads, wherein said plurality of microwave vibration heads are uniformly distributed on said inner wall of said body when viewing from the top of said dryer body; and said plurality of microwave vibration heads are arranged at different height between said wind screen and the top of said dryer body when viewing from a side of said dryer body, such that uniform distribution of microwave field can be produced inside said dryer body.

The edge of said wind screen includes a plurality of supporting feet which are respectively secured to pillar feet arranged on a periphery of said base.

Said base is a disc object with its center that is slightly concave downwardly, a hole is configured at the center of said base for connection to a hot air input port and a discharge port, said discharge port is used to discharge residue of said dried material and water inside said base, said hot air input port is connected with said air blower by a pipe for delivering air from said air blower to said dryer body; and a side of said base is engaged with the wall or a bottom of said body.

Wherein, said pipe connecting said hot air input port and said air blower is a straight pipe, or u-shaped or n-shaped pipe.

The present invention also provides a microwave drying method for drying a material comprising the following steps: (1) inputting material to be dried into a material collection compartment of a microwave dryer; (2) providing propeller to deliver said material to be dried from said material collection compartment to a dryer body of the dryer, and at the same time to squeeze out water from said material to be dried, said propeller having an adjustable hole at an output port thereof for controlling a size of said material to be dried being delivered to said dryer body; (3) dispersing and suspending said material to be dried being inside said dryer body by an air from air blower; (4) drying the suspended said material to be dried by microwaves generated from at least one microwave vibration head mounted inside said dryer body; (5) discharging said dried material from an material discharge port on a top of said dryer body.

Said material to be dried is compressed to an elongated paste form before entering said dryer body.

Said air blower also extracts a hot air from a hot air discharge port provided on said dryer body with water in said hot air remaining in vapor cell, and then recycles said hot air back into said dryer body.

After the air is boosted through an air inlet into said dryer body by said air blower, said air is blown from said air inlet towards a wind screen where the air is obstructed to go in all directions substantially transverse to said wind screen and rotates; the air flows goes upward from an air gap between the wind screen and the dryer body along the inner wall of the dryer body, said air flows is rotated inside said dryer body and to drive rotation of said microwaves inside said dryer body.

The microwave dryer of the present invention has the following advantages: rapid and uniform heating in all directions, suitable heating conditions, no local temperature peak, rapid cut off of electricity, fast control of process, microwave reactor in smaller volume compared with conventional reactors, low operation cost and low energy loss. Because of the above characteristics, the microwave dryer of the present invention provides high productivity, high efficacy, small volume, small investment, low operation cost and low loss.

There is a wide range of materials suitable for microwave drying, their compositions and states are also different from each other and can be classified by shapes as liquid, paste, pulp, granular, flake, powder; and can be classified by types as vegetables, fruits, grains, medicine, aquatic products and agricultural products; the size can be as small as vegetable seed, as large as ginseng or mushroom. According to a study of microwave drying, the drying effect may be affected by size, shape, quantity, water content and positioning of the material in microwave furnace resonant cavity. Therefore, drying processes and parameters shall be selected properly for the microwave dryer according to the characteristics of the material such as dielectric property, thermal property, moisture content, shape and size.

The microwave dryer of the present invention can be used for any type of organic and biological materials, especially organic substances in the cereal food wastes, that are domestic garbage; also it is able to manage various types of rubbish for their treatments, reuses, processes and recycles; extraction and evaporation for sterilization; drying and storage of agricultural products.

DETAILED DESCRIPTION OF THE PREFERRED EMBODIMENTS

Figure 1:
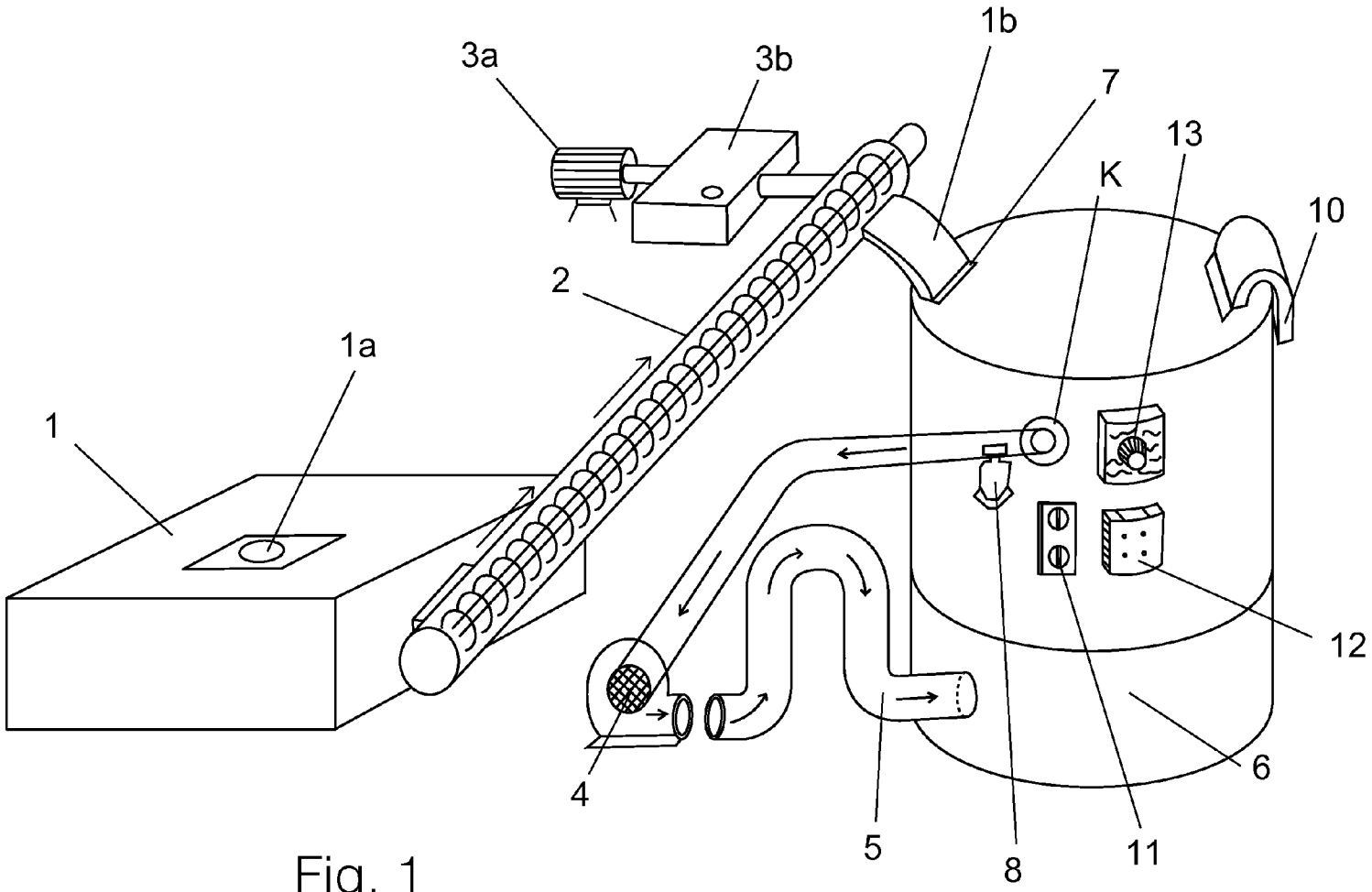
FIG. 1 is a schematic view of a microwave dryer of the present invention.

The definition of the microwave frequencies, the corresponding wavelength ranges and the relevant principle would be briefly described as follows. Based upon basic equations, wave equations and some solutions of the relevant problems are deduced, and the concepts of microwave penetration depth and energy absorption would then be introduced. Also is introduced the correlation of these two concepts with the thermal effects between microwave and the material, and the general microwave-based devices including a microwave source, waveguide and radiator would then be briefly introduced.

Microwave is a kind of electromagnetic waves with a frequency from 300 MHz to 300 GHz, ranging from low frequency of radio waves to high frequency between infrared and visible light. Therefore, the microwave is a non-ionizing radiation. A microwave system generally includes three components comprising a microwave source, a waveguide and a radiator.

The microwave source: that is the magnetron comprises a vacuum tube, a core of the vacuum tube has a cathode tube with high radiation source (that is, electrons could be emitted). Anodes with specific structure are distributed around the cathode tube, these anodes form a resonant cavity and couple with an edge of the field to generate a microwave resonant frequency. The electrons of the radiation accelerate rapidly due to the strong electric field. However, the electrons would be deviated and thus resulting a spiral movement of the electrons because of the presence of orthogonal magnetic field. The resonant cavity can gain energy from the electrons by appropriate selection of level of the electromagnetic field. This phenomenon is similar to the pleasing echo upon whistling towards a bottle. The electromagnetic energy stored can be transmitted to the waveguide or coaxial lines through ring antenna by the resonant cavity. The output power of the magnetron is controlled by level of current or strength of magnetic field. The maximum power is usually limited by the temperature of the anode, so as to ensure that the anode would not be melted. The power is limited to 1.5 kW and 25 kW when the microwave is in a frequency of 2 GHz to 45 GHz, and the electrodes are cooled using air or water. The magnetron with frequency of 915 MHz has a larger resonant cavity because low resonant frequency has a longer wavelength, and therefore such unit area can receive a higher energy. However, the heating efficiency of the microwave is usually low in the existing technology due to unreasonable matching.

The waveguide: the electromagnetic waves can be spread by communication lines (such as coaxial cables) and the waveguide. As the energy loss during transmission of high frequency electromagnetic waves (including microwave) by the waveguide is lower, the waveguide can be used for transmission of microwave energy. In principle, the waveguide is a hollow conductor with circular or rectangular cross-section, and the size of its internal dimensions determines the minimum transmission frequency (so-called cut-off frequency) defined by the wave equations and the corresponding boundary conditions (the microwave could not be spread if lower than these conditions). The cut-off frequency fc can be derived from a rectangular width (a) and a height (b) of the waveguide. The form of wave transmission in the waveguide is known as modes which determine the distribution of electromagnetic field inside the waveguide. These modes can be divided into a transverse electric field (TE) and transverse magnetic field (TM) to respectively describe the propagation direction of the electric field and the magnetic field. The most commonly used waveguide is a rectangular intersection field having a width (a) twice of its height (b), represented by $TE_{10}$.

The microwave radiator and tuner: when the microwave passes through a gap of heated material but is blocked ultimately, the waveguide itself can be used as the radiator for microwave heating. As the location of the electromagnetic field is changed with time, such structure is called a wave travelling device. Only when wall-current line obstruction occurs and the gap has exceeded a certain size, microwave radiation would be produced at the gap. This radiation is avoidable. In the field of microwave-based device, common standing wave equipment has further a slit arrangement (cutting off wall surface). In order to obtain high absorption and low reflection of microwave, impedance of the loaded radiator must match with impedances of the corresponding wave source and the waveguide during process of transmission from the radiator to the microwave source. Energy reflection is introduced in order to achieve this state and thus achieve efficient matching of energy and load.

As the load is changing during the process, it is necessary to continuously control this matching or optimization of the average load. Therefore, it is required to prevent return of residual reflected energy and to prevent overheating of the microwave source. The use of a circulator (a device associated with penetration of microwave) would result in the incident wave passing through while the reflected wave entering the additional load (which usually is water). In addition, it is possible to determine the reflected energy by the heated additional load.

The radiator is often divided into three categories in accordance with the structure of the electromagnetic field: near-field radiator, single-mode radiator and multi-modes radiator.

The penetration depth of the microwave in a material is inversely proportional to its frequency. In other words, short wave has shallower penetration depth of a material than long wave. In addition, the penetration depth of the electromagnetic wave in a material of high water content would not be too deep because the internal dielectric constant and the loss factor of a wet material are relatively high. The penetration depth is of importance for assessing uniform heating of the specific material by the electromagnetic field of a certain frequency.

Water in the wet material is usually divided into three categories: 1) free water between cells; 2) movable water layer between the free water and the bound water; 3) the bound water. The dielectric property of the free water molecules in the cells is similar to the dielectric property of liquid water, while the dielectric property of the bound water is similar to the dielectric property of ice. In general, dielectric property of the material is rapidly decreased when the water content is reduced to a critical value. When the water content is below the critical value, variation would not have great effect on the loss factor. However, high temperature can improve mobility of the bound water, thereby reducing the critical value of the water content.

The ability of a dry object to change the electromagnetic energy to heat energy is reduced, as the loss factor is also reduced along with decrease of the water content. In contrast, however, more microwave energy can be converted to heat energy by moisten part of the material than dry part of the material during microwave drying process. This can solve the problem of uneven distribution of moisture which is commonly found in the hot air drying process. The uneven distribution of moisture commonly presents because the internal part of the hot air drying material is wetter than the surface of the hot air drying material. This will also significantly shorten the drying time. The variation of temperature and humidity during microwave drying process is advantageous in understanding the interaction between the object and the electromagnetic field, and is also advantageous in calculation of the product development and control of sterilization, disinfection, re-heating and drying process system.

The heating rate and the uneven heating of the microwave are affected by factors of heating device and characteristics of the load (such as size, shape, dielectric property etc.). Any variation of one of parameters would significantly affect the microwave heating process. In this case, the most meaningful and practical mechanism includes dielectric polarization, dipole polarization, interfacial polarization, conduction effect and combination effect. The material can be heated by the microwave of high frequency, the heating effect is generated by interaction of electronics of the material inside the microwave field. These two main effects are caused by interaction of the heating effects. Taking electronics in carbon atoms as an example, if charged ions can pass through the material without hindrance, electric current would be generated in the electric field. However, if the charged ions are trapped in a region of the material, the electric field will drive those charged ions to move until the field force is balanced. Such movement of the charged ions will eventually cause dipole polarization inside the material. Both electronic conduction and dipole polarization can produce the heating effect under microwave radiation. The microwave heating is completely different from microwave spectroscopy. In addition, photons having specific energy (specific frequency) will stimulate the change of level of rotation of gaseous molecules, whereby rendering phenomenon of quantization. Instead of relying on the direct absorption of photons for achieving the heating, absorption of microwave by solid and liquid substances depends on the frequency of the microwave, and thus such absorption process cannot be quantized. The material is under the electric field of high frequency during the heating process, therefore conventional analysis methods could be used.

Under radiation of low frequency waves, dipole will make a response due to rearrangement by electric field effect, and molecules will gain energy simultaneously. The total heating effect is very small as collision of molecules would result in loss of some energy. Under electric field of high frequency, the dipole does not have sufficient time to respond to the electric field, and thus the dipole will not be able to rotate and no molecular movement could be performed, so no energy could be transmitted, and therefore no heating effect is produced. There is a frequency range between the extremes of high and low frequencies in which the dipole has sufficient time to make a response. This frequency range is the microwave frequency. There is sufficient time to rotate the dipole within the microwave frequency range as the frequency of the microwave is sufficiently low. If the frequency of the microwave is too high, the rotation cannot follow the frequency change. When the dipole is adapted to the arrangement in the electric field, direction of the electric field would be changed. As such, balance between the electric force and the dipole would then be intervened. This change in stability results in random collision of the dipoles, so as to complete dielectric heating process.

Molecular dipoles in solid cannot rotate as freely as molecular dipoles in liquid. The molecular dipoles in solid however are tied to a certain equilibrium position separated by a barrier. A theoretical treatment of this behavior in solid has been formularized, similar to formulas of the liquid. That is, dipole in solid has two directions. In order to understand special advantages of the microwave drying, the applicant has done a comparison between the existing air drying and the microwave drying. The existing air drying is divided into three stages. The first stage is a period of constant drying rate in a unit surface area. At this stage, water inside the particles will continuously flow out due to capillary action in order to keep the surface of the material in moisture. Factors determining and restricting the drying speed of this "constant rate zone" (that is, factors representing status of air flows) are temperature, relative humidity and air flow speed. The drying speed of the material can have a significant change by varying any one of these factors.

The situation would change dramatically at the next stage. It is necessary to address two transfer problems presented at the same time at this stage: water (water vapor) must be transferred from internal of the material to its surface in order to be brought out by the air flows, while the heat energy required for evaporation of water must also be conducted from the surface of the material to the internal of the material. During this process, the evaporation surface would be moved continuously towards the center of the material, such that transfer distance between the two transfers mentioned above would become shorter and shorter, and the evaporation surface area would decrease continuously. As a result, the drying speed would decrease rapidly. This stage is called "first deceleration zone". In this case, the drying speed could not be increased easily.

If it is desired to transmit more energy (heat), it has to use a larger temperature gradient. This means that the material surface has to be overheated or completely dried prematurely, resulting in deterioration (blackening or becoming carbonaceous). This is called "secondary deceleration zone". There is not much free water in this secondary deceleration zone. The water could only diffuse slowly to inner surface (if it is present), and then diffuse to the material surface by capillary tubes after desorption at the inner surface.

The microwave drying has a big difference in the two deceleration zones in comparison with the air drying. The microwave transfers energy in a different way. The microwave can penetrate the material to be dried, and heat the material entirely in all directions. A humid region of the material absorbs the microwave more easily than the dry area. Therefore, the temperature gradient of the dried material during the microwave drying would be inverted, that is the center of the material is hotter than the surrounding of the material. This would accelerate the transfer speed. If additional hot air drying is presented in the microwave drying, an overall operation of the transfer mechanism would be changed completely.

If some objects (such as liquid water) contain polar molecules and these molecules can oscillate freely, they can be heated by a microwave oven. When these objects are placed in a microwave propagation space, the polar molecules of these objects (especially water molecules which can respond to the microwave excellently), when subjecting to the electromagnetic field of the microwave in high frequency oscillation (microwave of 2.45 GHz is often used by the microwave oven), would vibrate together with the oscillating electric field along their polar direction. The inherent electromagnetic field of a molecule would be changed and then affect neighboring molecules, so that the molecules would be moved translationally. This translational movement is a main source of temperature of molecular population. Although non-polar molecules would also have some displacement polarization under the electric field, such displacement itself would not contribute to the temperature of the molecular population. Some of material per se have free polar molecules, and therefore can be heated directly by microwave. Other materials can also be heated indirectly by microwave through heating water if they are uniformly mixed with water.

Synchronous heating: for opaque solids, the microwave can penetrate in all directions into the sites of the material at a distance at least a few centimeters away from the material surface and heat these sites at the same time. This is different from infrared or visible light of electric oven, which can only reach the surface of the material. Therefore, the material can only be heated by transferring the heat energy from outside to inside of the material.

The above is the working principle of the microwave dryer of the present invention.

According to the above principle, the present invention provides a microwave dryer, as shown in FIG. 1. It is a drying device for accelerating extraction of water by microwave, including a feeding slot for placing the material to be dried into a container and extracting water from the material.

FIG. 1 shows a schematic view of the microwave dryer of the present invention. The microwave dryer comprises a material collection compartment 1 having an input port 1*a* and a dryer body 6. The material (such as rubbish) to be dried is cleaned and then fed from the input port 1*a* into the material collection compartment, wherein the material inserted into the material collection compartment would then be processed such as by shredding or stirring. The material in the material collection compartment 1 would be delivered to the dryer body 6 by a propeller 2. The propeller 2 is driven by a motor 3*a* and a gearbox 3*b*, a power of the motor 3*a* could be for example 3 horse powers and 1300 revolution per minute (rpm), the rotational speed of the propeller 2 can be changed by the gearbox 3*b* using ratio of gear sizes, for example 1:70 turns.

Preferably, the propeller 2 is configured obliquely upward, the material would be propelled upwardly from the bottom of the propeller, and at the same time the material is under gravitational force and compression by the propeller 2 such that the material in elongated paste form would be discharged from the output port 1*b*, and at the same time some or most of water in the material would also be squeezed out in order to facilitate microwave drying of the material.

The microwave dryer of the present invention can operate continuously for 24 hours everyday and 7 days every week. Its processing capacity can be up to 20 tons per day (24 hours).

The output port 1*b* of the propeller is connected with an input port 7 of the dryer body 6, the output port 1*b* may have different sizes of hole for delivering different diameters of the material in elongated paste form to the input port 7.

Figure 4:
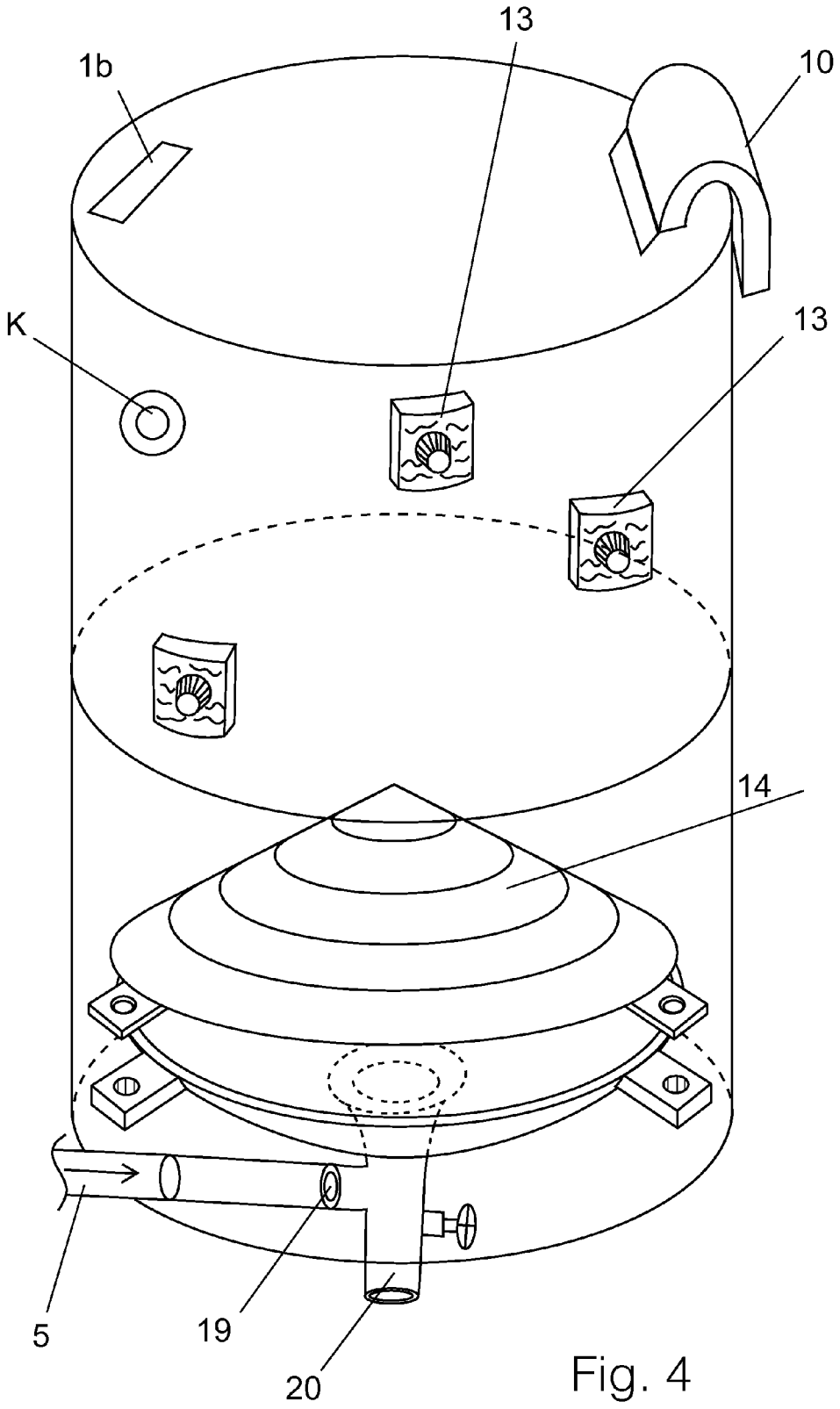
FIG. 4 is a perspective view of a dryer body of the microwave dryer of the present invention.

FIG. 4 is a perspective view of the main body of the microwave dryer of the present invention, but the components of the microwave dryer body 6 are still be drawn by solid lines for sake of clarity. As shown in FIG. 1 and FIG. 4, the dryer body 6 generally is in cylindrical shape with a diameter of about 1 meter, but it can also be other suitable shapes such as rectangular, cubical etc. The dryer body 6 comprises a main power supply 12 arranged outside the body 6 and a plurality of microwave vibration heads 13 (that is microwave source) arranged on inner wall of the body 6. Preferably, there are three microwave vibration heads in the body 6. It can be seen from the top of the body 6 that these three microwave vibration heads are evenly distributed on the inner wall of the body; while it can be seen from side of the body 6 that these three microwave vibration heads are arranged at positions of different heights, so that uniform distribution of microwave field can be produced from the body 6. The power of the microwave vibration head used by the microwave dryer of the present invention can be up to 1800 to 2000 watts (W), and frequency of the microwave vibration head is preferably 915 MHz to 2450 MHz.

The body 6 of the microwave dryer can be made of metal, such as aluminum or stainless steel. It can also be made of insulating material, such as plastic or resin. The inner or the outer wall of the body 6 can be coated with a layer of aluminum foil to shield the microwave, such that the microwave would not leak out from the body. In addition, coating of crystalline polyethylene terephthalate (CPET) or polytetrafluoroethylene (PTFE) can be used instead of the aluminum foil. Alternatively, other kinds of shields can also be installed on the inner or outer wall of the body 6, such as metal meshed cover etc.

According to the present invention, the microwave field is formed within a space defined by the wind screen 14, the top part of the body 6 and the side wall installed with the microwave vibration heads. As mentioned above, the plurality of the microwave vibration heads are positioned on the inner wall of the body at different heights, preferably the microwave vibration heads are uniformly distributed and positioned at a height between an edge of the wind screen 14 and the top part of the body 6 but along different radial directions on the body 6.

If three microwave vibration heads and the body 6 with a diameter of 1 meter are present, one of the microwave vibration heads would be arranged at the highest position of about 1 foot away from the top part of the body 6, while another one of the microwave vibration heads would be arranged at the lowest position of about 2.5 feet below the highest position, and the third microwave vibration head would be arranged at a position in a half of two microwave vibration heads arranged respectively at the highest and lowest positions. Two of the microwave vibration heads are spaced at a distance of about 1 meter or 3 feet.

A switch 11 and a charged power supply 12 can be installed on the outer wall of the body 6. The switch 11 can include a main power supply switch of the microwave dryer, and can further include a power adjustment switch of the microwave vibration heads 13. The charged power supply 12 is used to convert the mains input voltage (for example 50 HZ/220 VAC) to appropriate voltage for driving the microwave vibration head. A material discharge port 10 for discharging the dried material is configured on the top part of the body 6. The dried material is generally in a form of particles or powders.

The internal part of the body 6 further comprises a hot air extraction port K which is connected to an air blower 4. There is further provided with a vapor cell 8 near the hot air extraction port K. The vapor cell 8 is used for storing water condensed from the hot air to further improve the drying effect. The air blower 4 delivers the dried hot air extracted from the body 6 back to the body 6, such that utilization of the hot air can be improved and thus increasing the drying speed and saving energy.

Figure 2:
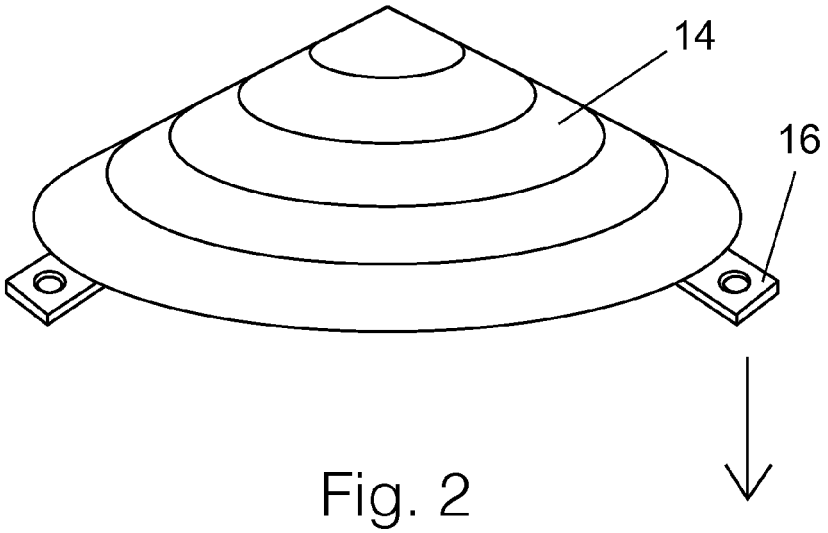
FIG. 2 is a top part of a hood-shaped wind screen in the microwave dryer of the present invention.
Figure 3:
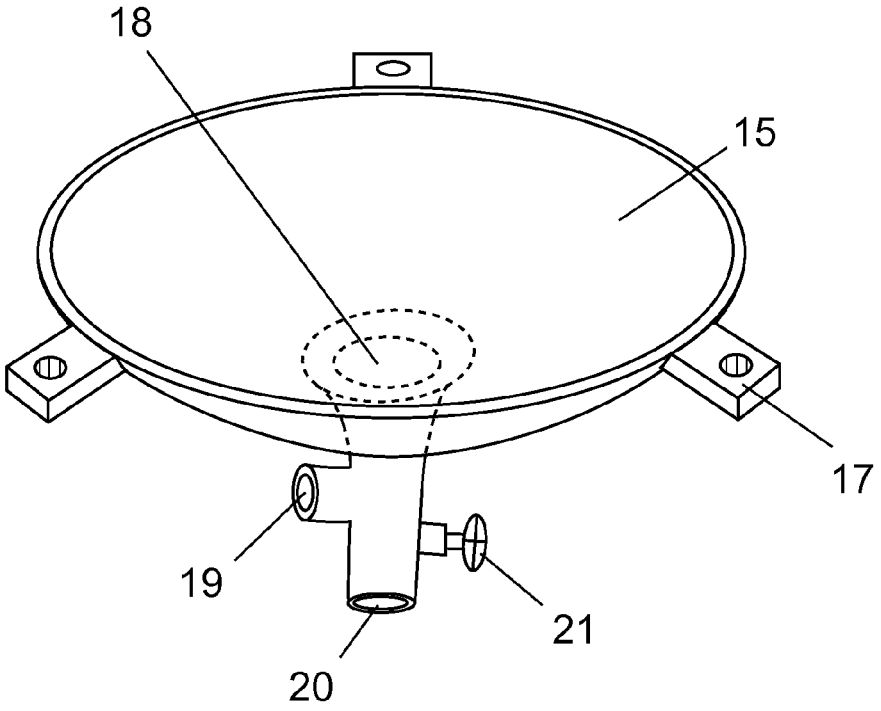
FIG. 3 is a base of the hood-shaped wind screen in the microwave dryer of the present invention.

FIG. 2 shows the top part of the hood-shaped wind screen in the microwave dryer of the present invention, and FIG. 3 is the base of the hood-shaped wind screen in the microwave dryer of the present invention.

A conical or hood-shaped wind screen 14 is installed at the bottom of the internal part of the body 6 for obstructing vapor, preventing leakage of microwave and orientating the air flows added into the body. The conical top of the wind screen 14 is facing upward. It may only include a conical surface, without bottom surface. The diameter of the edge of the conical or hood-shaped wind screen 14 is slightly less than the inner diameter of the microwave dryer body 6, that is there is a small gap between the outermost edge of the wind screen 14 and the inner wall of the microwave dryer body 6. The gap is about a few millimeters to several centimeters, for example 3-5 millimeters (mm).

In order to prevent the leakage of electromagnetic wave, the wind screen 14 can be made by metal, such as aluminum foil. It can also be made by insulating material coated with aluminum foil, crystalline polyethylene terephthalate (CPET) or polytetrafluoroethylene (PTFE). The wind screen 14 is in conical or hood shape, so that the material or their residues landing on the wind screen 14 can fall on the edge of the wind screen 14 because of the gravity, and can be blown up by wind or can fall into the base 15 of the wind screen. Therefore, there is no special requirement for the height of the wind screen 14, as long as the wind screen 14 is in conical or hood shape.

The edge of the wind screen 14 includes a plurality of supporting feet 16, which are installed to respective pillar feet 17 on a periphery of the disc-shaped base 15. The disc-shaped base 15 is shown in FIG. 3. After installation, there is a certain gap between the wind screen 14 and the disc-shaped base 15, such that hot air or air can be blown out to pass through the gap. The gap can also be about a few millimeters to several centimeters, for example 3-5 mm. Preferably, there would have three pillar feet 17 and three supporting feet 16, which are uniformly distributed on the wind screen 14 and disc-shaped base 15, respectively.

The disc-shaped base 15 is a disc with its center that is slightly concave downwardly. A hole 18 is configured at a position approximate to the center of the base 15 for connection to a hot air input port 19 and a discharge port 20. The discharge port 20 is used for discharging water or residue of the material accumulated in the body 6. The discharge port is normally closed. When it is necessary for discharge, a valve 21 would be opened for allowing discharge of water or residue of the material accumulated in the base 15 (although most of the dried material are discharged from the material discharge port 10). The base 15 can be made of plastic, resin, fiber material or metallic material.

In addition, the wind screen 14 and the edge of the base 15 can also be other suitable shapes than round shape (for example in oval or polygon shape) or can have tooth-shaped grooves. It is possible that there is a plurality of holes on the conical surface of the wind screen 14 for boosting out air to blow and disperse and suspend the material to be dried which have been introduced.

The hot air input port 19 is connected with the air blower 4 by a pipe 5, such that the air blower 4 can deliver air to the microwave dryer body 6 for blowing and dispersing and suspending the material to be dried which have been introduced. At the same time, the hot air extracted by the hot air extraction port K would also be delivered back to the body 6 by the air blower 4 via the hot air input port 19. Preferably, the pipe 5 is a straight pipe or bending pipe, such as u-shaped or n-shaped pipe. One of the advantages of using u-shaped or n-shaped pipe is that small amount of microwave leaking from the body 6 can be shielded by the pipe 5. The material in elongated paste form delivered to the body 6 from the input port 7 would be blown and dispersed by the air blower 4 to become particles, and those particles would then be suspended inside the body 6 so as to be convenient for performing microwave drying process. Furthermore, the time for processing and drying the material in elongated paste form is significantly shorter than the time for processing and drying the bulk material.

The rotational speed of the air blower 4 can be adjusted (for example an input wind speed is 2460 revolutions per minute (rev/min)), depending on the amount of the material to be dried ready to be fed to the body 6 by the propeller 2.

The base 15 can serve as a base of the microwave dryer body 6, or the microwave dryer body 6 can additionally have an individual base (not shown in Figure). The body 6 can be installed on the ground or floor by additional brackets.

Therefore, the microwave dryer of the present invention is a rapid container which extracts water by penetrating property of microwave. The wind screen 14 is configured inside the body, the wind screen can serve as a heat storage body for temporarily storing heat energy when the material generates heat inside the body. The hot air of the body would then be extracted by a ventilation system and introduced back into the container from the base, so that the heat energy would be increased gradually and rapid drying effect would be achieved.

The propeller 2 would squeeze out most of water from the material to be dried, and feed the material from the material input port to the body. The volume of the fed material would be controlled by an adjustable hole of the input port. Subsequently, the fed material to be dried would be blown and dispersed by air from the air blower.

The penetrating property of microwave enables the microwave penetration into the material fed into the body 6 and suspended inside the body in all directions within a short period of time. When the material is penetrated by microwave, high speed friction between the molecules of the material would occur to generate heat energy, so that the water of the material would be evaporated. The hot air would also be generated by the body 6, with a temperature up to 80° C. The hot air carries the water of the material. The hot air is subsequently extracted by the hot air extraction port, and most of water would be remained in the vapor cell by vapor filtering cell 8 using the pipe 5, and then the hot air is recycled back into the body.

When the hot air has entered into the body, the hot air would be blown from the bottom towards the base of the hood-shaped wind screen 14 through the hot air input port 19, and a small amount of moisture administrated into the body would be blocked by the hot air through the top part of the wind screen. The vapor carrying a certain amount of heat energy is formed on the base 15. The heat energy can be temporarily stored inside the base 15, so that a certain temperature can be maintained within the body.

As the air is blocked by the top part of the wind screen and thus the air flow would be impeded, the air would go in all directions substantially transverse to the wind screen and rotates. The edge of the wind screen has a position for letting out the air. The air flows goes upward from the air gap between the wind screen and the dryer body along the inner wall of the dryer body. After the air flow has reached the top part of the body, the air flow would only rotate inside the container, except the pipe of the material output port. Such an air flow recycle will drive rotation of the microwave energy inside the body to have overflowing rotation. Therefore, the drying can be strengthened with improved efficient heating.

The air blower capable of controlling switching adjustment and the regulator capable of controlling the level of the microwave are very important for achieving an efficient drying. When the temperature inside the body reaches a required temperature, the microwave vibration heads 13 would shut down themselves, thus thermal runaway of the dryer would not happen. The body of the dryer would be shifted to use the heat energy remaining therein to perform the drying in order to save energy.

The dryer of the present invention is structured based on the physical phenomena that the material molecules lighter than air will rise up while the material molecules heavier than air will sink. The weight of the material itself will become lighter and become particles or powders after the water is extracted from the material. As such, the dried material can be carried out of the body by air if the air is sufficiently strong. Finally, the dried material can be packed for storage.

It is unnecessary to classify and pre-treat the material to be dried. It is only required to clean the rubbish to be processed by water to remove odor before inputting it into the material collection compartment. The rubbish to be processed can be inputted to the material collection compartment after cleaning and removing the odor, and then can be fed into the microwave dryer body by the propeller. Any organic material is heated and dried only by making use of the penetrating property of microwave to generate the heat energy for evaporating water. The size of the dried material is selected to be suitable for microwave penetration. The time required for the penetration is shorter with better result if the size of the material is finer. The material to be dried can be fed continuously into the container as long as there is sufficient space for suspending the material inside the container (the material in the amount about ⅓ volume of the body is sufficient for the material flying and rotating), and the dried material can also be discharged continuously from the body, such that the dryer can be operated in a flow through manner. The microwave dryer of the present invention can perform the drying process at a speed of 20 tons of material per day (24 hours).

The present invention also provides a rapid and energy-saving drying method for the material, the method comprises the following steps:

(1) inputting the material to be dried after cleaning into the material collection compartment of the microwave dryer;

(2) using the propeller to squeeze out most of water from the material to be dried, and feeding the material from the material input port of the body into the body, wherein the volume and shape of the material are controlled by an adjustable hole;

(3) dispersing the material to be dried being fed by air from the air blower at a variable blowing rate and suspending the material inside the body;

(4) generating the hot air carrying water of the material, and then extracting the hot air from the hot air output port by the air blower, and keeping most of water in the vapor cell by vapor filtering cell in the pipe, and subsequently recycling the hot air into the body;

(5) blowing the hot air towards the hood-shaped wind screen through the air gap when the hot air is brought into the body, while a small amount of moisture being brought into the body by the hot air is blocked by the hood-shaped wind screen to form the vapor carrying some heat energy on the base of the hood-shaped wind screen. The vapor remains on the base for temporary storage of the heat energy, such that a heat storage position is present inside the container and the body can maintain a certain temperature;

(6) when the air is blocked by the wind screen, the air would then be directed in all directions substantially transverse to the wind screen and rotates, further, the air gap between the wind screen and the body allows for letting out the air flow which rises from the outermost edge of the wind screen along the inner wall of the body; after the air flow has reached the top part of the body, the air flow would be permitted to only rotate inside the container, except the pipe positioned at the material output port, to drive rotation of the microwave inside the body to have overflowing rotation; therefore, the drying can be strengthened with improved efficient heating.

According to the technical solution of the present invention, besides the body, the air blower for controlling switching adjustment of air strength and the regulator for controlling the quantity of the microwave are also very important for achieving an efficient drying. When the temperature inside the body reaches as required, the microwave vibration heads would shut down themselves, thus thermal runaway of the dryer would be avoided. The body would then be shifted to use the heat energy remaining therein to perform the drying in order to save energy.

The dryer of the present invention is structured based on the physical phenomena that the material molecules lighter than air will rise up while the material molecules heavier than air will sink. The weight of the material itself will become light after the water is extracted from the material. The dried material can be carried out of the body by air if the air is sufficiently strong. Finally, the dried material would be packed for storage.

The dryer and the drying method of the present invention can fully dry a large amount of material within a short time with minimum consumption of energy, and would cause minimal damage to the material because the drying time is short, while the optimal drying result can be achieved.

According to the present invention, most of the water in the material would be squeezed out by the propeller before drying the material. The material would then be compressed to have an elongated paste form; and then the material in elongated paste form will be dispersed by hot air to become small particles suspending inside the microwave dryer body; at this time, the material in small particles can be dried by the microwave with consumption of low energy within a short time. Therefore, the microwave dryer of the present invention is energy saving.

On the other hand, the material is compressed to have elongated paste form before it is fed to be dried, therefore the present invention can be used for drying any kind of materials. According to the dryer of the present invention, the drying time, drying speed and drying efficiency are irrelevant to the type of material, but depend on the size of the elongated material after compression.

Although the preferred embodiment described above has described the concept of the present invention in details, a person skilled in this technical field of the art can perform appropriate modification and/or adjustment under guidance of the inventive concept of the present invention. Therefore, the spirit and scope of the present invention should not be limited to the preferred embodiments of the present invention as described above.

What is claimed is:

1. A microwave dryer for physically drying and recycling a waste material comprising:

a material collection compartment having an input port through which the material to be dried is fed into said material collection compartment;

a dryer body comprising at least one microwave vibration head configured on an inner wall of said dryer body for generating microwaves to dry said material and to heat air to produce hot air in said dryer body, said dryer body further comprising a hot air extraction port;

a propeller having an output port laterally arranged relative to a length of the propeller, wherein the propeller is connected to said material collection compartment and said dryer body for delivering said material to be dried from said material collection compartment through said output port to said dryer body, and connected to a motor and a gearbox for driving the propeller and changing a rotational speed of the propeller at which said material to be dried is propelled, compressed and discharged in a paste form;

a conical, oval conical or hood-shaped wind screen with its conical top facing upward, wherein an outermost edge of said wind screen and said inner wall of said dryer body are arranged with a gap;

a circular or ovoid base having a central hole in communication with a hot air input port arranged at a bottom of said dryer, and said base being configured to be spaced apart from said wind screen to define a space therebetween; and an air blower connected to said hot air extraction port of said dryer body, through which said air blower delivers the hot air extracted from said dryer body back to the space defined by said wind screen and said base through the hot air input port arranged at the bottom of said dryer and the central hole, the hot air delivered into said space being guided such that the hot air is able to only flow substantially transverse to said wind screen and goes upward along the gap between said wind screen and said dryer body to fill up and rotates inside an entire interior of said dryer body, so as to disperse and suspend said material to be dried inside the dryer body;

wherein the rotation of the hot air dries the suspended material to dryness, and the dried material is outputted in a form of particles or powders.

2. A microwave dryer according to claim 1, wherein said dryer body further comprises a power adjustment switch for adjusting power of said microwave vibration head.

3. A microwave dryer according to claim 1, wherein said gearbox uses a ratio of size of gears to change the rotational speed of said propeller.

4. A microwave dryer according to claim 1, wherein said propeller is configured obliquely upward and said material to be dried inside said material collection compartment is delivered upwardly from a bottom of said propeller to said dryer body, said material is compressed by said propeller during the delivery, such that said material is under gravitational force and compression by the propeller at the same time, so as to squeeze out water from said material during said delivery.

5. A microwave dryer according to claim 4, wherein said output port of said propeller has an adjustable size to facilitate delivery of different sizes of the material in the paste form to an input port of said dryer body.

6. A microwave dryer according to claim 1, wherein said dryer body is of hollow cylindrical, rectangular or cubical configuration.

7. A microwave dryer according to claim 1, wherein said dryer body comprises three microwave vibration heads which are uniformly distributed on said inner wall of said dryer body when viewing from a top of said dryer body, and which are arranged at different heights of said inner wall of said dryer body when viewing from a side of said dryer body, such that uniform distribution of a microwave field is produced inside said dryer body.

8. A microwave dryer according to claim 7, wherein a diameter of said dryer body is 1 meter;

among said three microwave vibration heads, one of them is configured at the highest position of 1 foot away from the top of the dryer body while another one of them is configured at the lowest position of 2.5 feet lower from said highest position, and the third microwave vibration head is at a height of a half of said lowest and highest positions, two of microwave vibration heads are spaced at a distance of 1 meter or 3 feet.

9. A microwave dryer according to claim 1, wherein said microwave vibration head has a power of 1800-2000 watts with a frequency of 915 MHz-2450 MHz.

10. A microwave dryer according to claim 1, wherein said inner wall or an outer wall of said dryer body is coated with one or more layers of coating selected from the group consisting of aluminum foil, crystalline polyethylene terephthalate (CPET) and polytetrafluoroethylene (PTFE) for shielding said microwaves such that said microwaves do not leak out of said dryer body.

11. A microwave dryer according to claim 1, wherein said dryer body further comprises a switch and a charged power supply on an outer wall of said dryer body.

12. A microwave dryer according to claim 1, wherein said dryer body further comprises at least one material discharge port arranged on a top of said dryer body for outputting the dried material provided in the form of particles or powders.

13. A microwave dryer according to claim 1, wherein said body further comprises a vapor cell adjacent to said hot air extraction port for storing condensed water from said hot air.

14. A microwave dryer according to claim 1, wherein the edge of said wind screen includes a plurality of supporting feet which are respectively secured to pillar feet arranged on a periphery of said base.

15. A microwave dryer according to claim 1, wherein said base is a disc with its center that is slightly concave downwardly, and with a discharge port, said discharge port is used to discharge residue of said dried material and water inside said base; and a side of said base is engaged with the wall or a bottom of said dryer body.

16. A microwave dryer according to claim 1, wherein said central hole is in communication with the hot air input port arranged at the bottom of said dryer by a pipe, and said pipe connecting said hot air input port and said hot air input port is a straight pipe, or u-shaped or n-shaped pipe.

17. A microwave dryer according to claim 1, wherein said dryer body comprises a plurality of microwave vibration heads which are uniformly distributed on said inner wall of said dryer body when viewing from the top of said dryer body, and which are arranged at different heights between said wind screen and the top of said dryer body when viewing from a side of said dryer body, such that uniform distribution of a microwave field is produced inside said dryer body.

18. A microwave dryer according to claim 1, wherein said material to be dried comprises any type of organic and biological material.

19. A microwave dryer according to claim 1, wherein said material to be dried comprises organic substances of cereal food wastes, that are domestic garbage.

20. A microwave drying method for physically drying and recycling a waste material employing a microwave dryer, the microwave dryer comprising:

a material collection compartment having an input port through which the material to be dried is fed into said material collection compartment;

a dryer body comprising at least one microwave vibration head configured on an inner wall of said dryer body for generating microwaves to dry said material and to heat air to produce hot air in said dryer body, said dryer body further comprising a hot air extraction port;

a propeller having an output port laterally arranged relative to a length of the propeller, wherein the propeller is connected to said material collection compartment and said dryer body for delivering said material to be dried from said material collection compartment through said output port to said dryer body, and connected to a motor and a gearbox for driving the propeller and changing a rotational speed of the propeller at which said material to be dried is propelled, compressed and discharged in a paste form;

a conical, oval conical or hood-shaped wind screen with its conical top facing upward, wherein an outermost edge of said wind screen and said inner wall of said dryer body are arranged with a gap;

a circular or ovoid or ovoid base having a central hole in communication with a hot air input port arranged at a bottom of said dryer, and said base being configured to be spaced apart from said wind screen to define a space therebetween; and an air blower connected to said hot air extraction port of said dryer body, through which said air blower delivers the hot air extracted from said dryer body back to the space defined by said wind screen and said base through the hot air input port arranged at the bottom of said dryer and the central hole, the hot air delivered into said space being guided such that the hot air is able to only flow substantially transverse to said wind screen and goes upward along the gap between said wind screen and said dryer body to fill up and rotates inside an entire interior of said dryer body, so as to disperse and suspend said material to be dried inside the dryer body;

wherein the rotation of the hot air dries the suspended material to dryness, and the dried material is outputted in a form of particles or powders, comprising the following steps:

(1) inputting the material to be dried into said material collection compartment of said microwave dryer;

(2) providing said propeller to deliver said material to be dried from said material collection compartment into said dryer body of the dryer, and at the same time to squeeze out water from said material to be dried, said propeller having an adjustable hole at said output port thereof for controlling a size of said material to be dried being delivered to said dryer body, wherein said propeller is configured to have an output port laterally arranged relative to a length of the propeller, and said propeller is connected to said motor and said gearbox for driving the propeller and changing said rotational speed of the propeller at which said material to be dried is propelled, compressed and discharged in said paste form;

(3) dispersing and suspending said material to be dried inside said dryer body by hot air coming out from said bottom of said dryer, wherein the hot air is extracted from said dryer body by said air blower back to said dryer body;

(4) drying the suspended material to be dried by microwaves generated from said at least one microwave vibration head mounted inside said dryer body;

(5) discharging said dried material from a material discharge port on a top of said dryer body in said form of particles or powders.

21. A microwave drying method according to claim 20, wherein said air blower extracts the hot air from the hot air discharge port provided on said dryer body with water in said hot air remaining in a vapor cell, and then recycles said hot air back into said dryer body.

* * * * *